US006179509B1

(12) United States Patent
Suits

(10) Patent No.: US 6,179,509 B1
(45) Date of Patent: Jan. 30, 2001

(54) SAFETY SIGN BOOK

(75) Inventor: Bevan D. Suits, Decatur, GA (US)

(73) Assignee: Perkins & Will, S.E., Atlanta, GA (US)

( * ) Notice: Under 35 U.S.C. 154(b), the term of this patent shall be extended for 0 days.

(21) Appl. No.: 09/431,731

(22) Filed: Nov. 1, 1999

(51) Int. Cl.[7] ..... B42F 13/00

(52) U.S. Cl. ..... 402/79; 281/29; 281/37; 281/33; 402/4

(58) Field of Search ..... 281/21.1, 15.1, 281/22, 28, 29, 31, 36, 37, 38, 45, 51; 402/79, 70, 73

(56) References Cited

U.S. PATENT DOCUMENTS 3,797,135 * 3/1974 Linker et al. ..... 281/33
3,952,989 4/1976 Hatcher .
5,154,391 10/1992 Hegarty .
5,375,937 12/1994 Oh .
5,603,528 * 2/1997 Chen ..... 281/33
5,607,067 3/1997 Morrissey .
5,632,566 5/1997 Korzilius et al. .
5,797,578 8/1998 Graffeo et al. .
5,876,143 3/1999 Datum .

* cited by examiner

*Primary Examiner*—Willmon Fridie, Jr.
(74) *Attorney, Agent, or Firm*—Sutherland & Asbill & Brennan LLP

(57) ABSTRACT

The present invention provides a book for vertically displaying safety information on selected pages. The book is particularly well-suited for use in laboratory, hospital and industrial environments where emergency situations can prevent access to remote reference manuals. The book has front and back covers with a releasable mounting means for mounting the book in a vertical position on a planar surface. The book also has a plurality of adjacent informational pages releasably adhered together, and a binder.

8 Claims, 1 Drawing Sheet

SAFETY SIGN BOOK

BACKGROUND OF THE INVENTION

In environments where hazardous materials are handled by personnel, such as in laboratories, hospitals or industrial environments, immediate access to emergency treatment and materials containment procedures can be critical. Appropriate steps to minimize health risks associated with a chemical, biological or radioactive material spill must be taken immediately to prevent collateral harm.

There currently does not exist a sign book for displaying safety information in an optimum format for emergency reference. The prior art relies on large cumbersome reference manuals that are often stored on remote bookshelves or in offices. Prior art designs do not provide adequate visual display and convenience of page turning for emergency situations.

What is needed in the art is an informational sign book that can be readily displayed and accessed in a hospital, laboratory or industrial environment. What is needed is a safety sign book that permits users to quickly locate and review emergency procedure information with a minimal amount of effort.

SUMMARY OF THE INVENTION

The present invention provides a book for vertically displaying safety information on selected pages. The book is particularly well-suited for use in laboratory, hospital and industrial environments where emergency situations can prevent access to remote reference manuals. The book has front and back covers with a releasable mounting means for mounting the book in a vertical position on a planar surface. The book also has a plurality of adjacent informational pages releasably adhered together, and a binder.

DETAILED DESCRIPTION OF THE INVENTION

Figure 1:
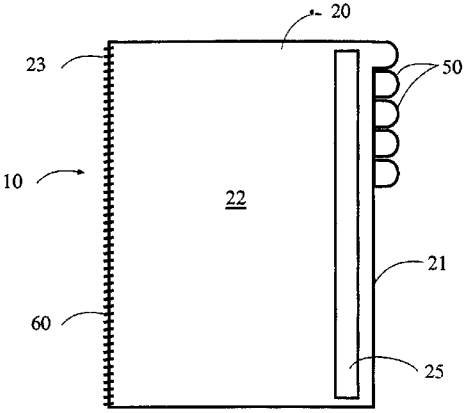
FIG. 1 shows a front view of one embodiment of the present invention in the closed position.

The present invention provides a book for vertically displaying safety information on selected pages. The book is particularly well-suited for use in laboratory, hospital and industrial environments where emergency situations can prevent access to remote reference manuals.

The book has front and back covers each having an exterior surface and an interior surface. The exterior surfaces of the front and back covers each have permanently attached thereto a releasable mounting means for mounting the book in a vertical position on a planar surface, i.e. a wall. The releasable mounting means provides a friction coefficient sufficient to maintain the sign book mounted in a vertical position on a planar surface, however, the friction coefficient is minimal enough to permit a user to remove the entire book by pulling it away from the wall if needed for reference. The exact value of the friction coefficient is not critical and will vary widely depending upon the materials used for construction of the book, and the type of mounting means.

A suitable releasable mounting means is a hooked surface releasably attached to a reciprocating loop strip backed with an exposable adhesive layer. VELCRO® is such a commercially available hook and loop mounting means. Other mounting means including adhesives or conventional snap buttons will also function in the present invention. In preferred embodiments, the releasable mounting means is located adjacent the non-bound edges on the exterior surfaces of the covers. Preferably, the releasable mounting means is a hook and loop strip about one inch wide extending along the length of the non-bound edge of the exterior surfaces of the covers.

The book also has a plurality of adjacent informational pages between the front and back covers. The pages and covers can be any size, however, to optimize visual access while mounted on a wall, the pages should be at least about 8 ½"×11". Preferably, the covers and pages are laminated with a waterproof polymer material to prevent the information from becoming unreadable in the event that the book becomes contaminated with a materials spill. Each page has a bound edge and a non-bound edge. Further, an icon-bearing tab extends from each of the non-bound edges corresponding to the information presented on the attached page. The tabs are arranged such that viewing any one tab on a page is not obstructed by the tabs on any of the other pages. For example, the tab on the first page can be located near the top of the page, and the tab on the next adjacent page can be located lower than that on the first page.

Importantly, each page is releasably adhered to the adjacent page or to the interior surface of the front or back cover, such that selection of a tab, separation of that page, turning and re-adhering of the undesired page can be performed in a single-handed operation. The user needs to only grip one icon-bearing tab and turn the page thereto, without the necessity of re-positioning the hand or moving other parts of the book out of the way. Thus, the book provides visual access to an open page while mounted on the wall without the risk of inadvertent page turning. Further, the invention also provides that any number of multiple pages can be turned at a time in a single-handed, single-motion operation by simply selecting an icon-bearing tab and turning to the attached desired page, while the pages between remain adhered to one another.

The releasable adherent between adjacent pages, or between a page and an adjacent cover, is preferably reciprocating hook and loop structure, such as VELCRO®. A hook and loop strip of about ¼"×1" located adjacent the tab on each page is preferred, but any shape of hook and loop strip at that location will function. By placing the releasable adherent adjacent the tab, a user can grasp the tab and open the book to the page of interest without opening the book to an inadvertent page. Other suitable adhesives or button snaps in other locations on each page may also be employed, as long as the ability to turn any number of the pages together, and re-adhere them to the book, in a single-handed operation is maintained.

The book also has a binder for retaining the front and back covers and the pages along the bound edge. Preferably, the binder is a spiral wire, or a ring binder permitting removal and exchange of pages. Any well-known binding mechanism will function in the present invention.

In an emergency situation in a hospital or laboratory environment, it may be impossible to safely leave the immediate area and locate the relevant portions of a conventional reference manual. The present invention provides such information on display at the likely site of such caustic accidents. Therefore, the pages of the present invention contain laboratory or hospital safety information in a visually accessible and easily referenced format. The ability to turn to any selected page in only a single-handed operation is advantageous over conventional materials safety reference manuals. The safety information can be tailored to small or large volume spills, and to those with and without injury to personnel. The book can also provide locations for the users to provide other specific information, such as local telephone numbers or the names of supervisors. In addition to the information contained in the written text, the book can also convey information in the form of symbols, icons, characters and internationally recognized designations.

The safety information may be related to hazardous materials spills on personnel, such as radiological, chemical or biological spills. In such a case, an appropriate icon for the tab corresponding to that information can be an outline of a person. The information on the page can include instructions to remove the contaminated clothing, rinse exposed skin with an appropriate solvent, seek medical attention, and report the incident to a supervisor.

The safety information may be related to chemical spills on other surfaces in the laboratory or hospital environment. In such a case, an appropriate icon for the tab corresponding to that information can be an outline of an Ehrlenmyer flask. The information on the page can include instructions to alert people in the immediate area, wear protective equipment, confine the spill, use appropriate neutralizing materials to absorb the spill, dispose of the collected residue, and contact the safety office for waste pickup.

The safety information may be related to biological spills on other surfaces in the laboratory or hospital environment. In such a case, an appropriate icon for the tab corresponding to that information can be an outline of an international biohazard symbol. The information on the page can include instructions to alert everyone in the laboratory, attend to injured or contaminated people, remove contaminated clothing, isolate the area, wash affected skin, wait a specified time before re-entering to allow aerosols to dissipate, and wear protective equipment when cleaning the spill.

The safety information may be related to radiation spills on other surfaces in the laboratory or hospital environment. In such a case, an appropriate icon for the tab corresponding that information can be an international radiation symbol. The information on the page can include instructions to isolate the spill and guard against re-entry, alert those in the area, assemble all potentially contaminated persons and monitor them for contamination, contact the radiation protective office, remove contaminated clothing, and remain available for questioning.

Figure 3:
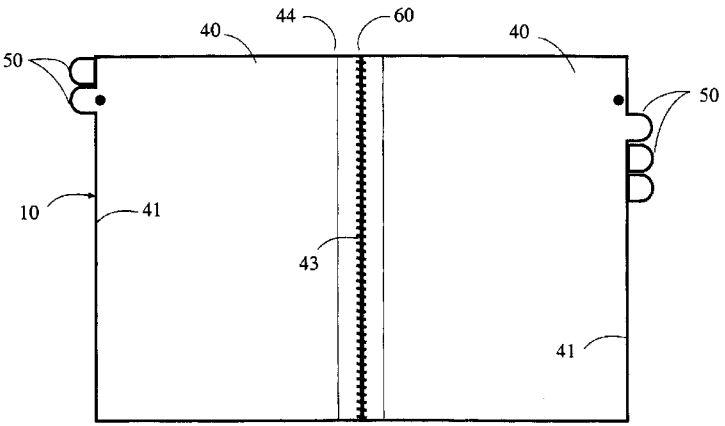
FIG. 3 shows a view of an embodiment of the present invention in the open position.
Figure 2:
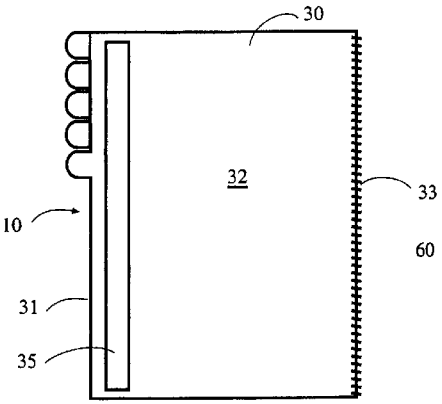
FIG. 2 shows a back view of one embodiment of the present invention in the closed position.
Figure 4:
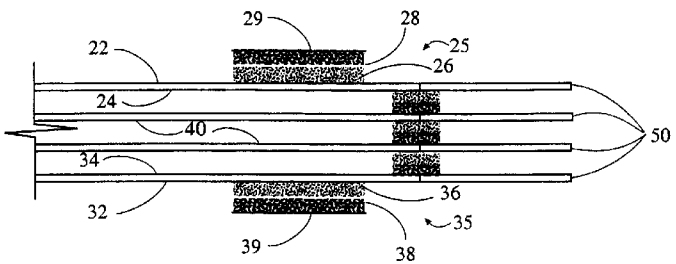
FIG. 4 shows a detail view of an embodiment of the present invention utilizing hook and loop mounting means and releasable adherent between the pages.

Referring to the particular embodiments of the Drawings, FIG. 1 shows a front view of one embodiment of the present invention in the closed position. FIG. 2 shows a back view of one embodiment of the present invention in the closed position. FIG. 3 shows a view of an embodiment of the present invention in the open position. FIG. 4 shows a detail view of an embodiment of the present invention utilizing hook and loop mounting means and releasable adherent between the pages. FIGS. 1–4 show a book 10 for vertically displaying safety information on selected pages 40. The book 10 has a front cover 20 and a back cover 30, each having an exterior surface 22,32 and an interior surface 24, 34. The exterior surfaces 22,32 of the front cover 20 and back cover 30 each have permanently attached thereto a releasable mounting means 25,35 for mounting the book 10 in a vertical position on a planar surface, such as on a wall.

The releasable mounting means 25,35 shown in this embodiment is a hooked surface 26,36 releasably attached to a reciprocating loop strip 28,38 backed with an exposable adhesive layer 29,39. The mounting system provides a friction coefficient sufficient to maintain the sign book 10 mounted in a vertical position on a planar surface, however, the friction coefficient is minimal enough to permit a user to remove the entire book 10 by pulling it away from the wall if needed for reference. The releasable mounting means 25,35 is located adjacent the non-bound edges 21,31 on the exterior surfaces 22,32 of the covers 20,30.

The book 10 is also shown with a plurality of adjacent informational pages 40 between the front and back covers 20,30. The pages 40 and covers 20,30 each have a bound edge 23,33,43 and a non-bound edge 21,31,41. Further, an icon-bearing tab 50 extends from each of the non-bound edges 21,31,41 corresponding to the information presented on the attached page 40. The tabs 50 are arranged such that viewing any one tab on a page is not obstructed by the tabs on any of the other pages.

Each page 40 is releasably adhered to the adjacent page 40 or to the interior surface 24,34 of the front or back cover, such that selection of a tab 50, separation of that page 40, turning and re-adhering of the undesired page 40 can be performed in a single-handed operation. Thus, the invention provides that any number of multiple pages can be turned at a time in a single-handed, single-motion operation by simply selecting an icon-bearing tab 50 and turning to the attached desired page 40, while the pages between remain adhered to one another. The book 10 also has a binder 60, shown here as a spiral wire, for retaining the front and back covers 20,30 and the pages 40 together along the bound edges 23,33,43.

The releasable adherent 45 between adjacent pages 40, or between a page 40 and an adjacent cover 20,30, is shown as a reciprocating hook 46 and loop 48 structure. By placing the releasable adherent 45 adjacent the tab 50, a user can grasp the tab 50 and open the book 10 to the page 40 of interest without opening the book 10 and flipping through multiple undesirable pages 40. As is shown, the releasable adherent 45 is significantly smaller that the releasable mounting means 25, 35 on the covers 20,30, so that the entire book 10 is not dislodged from its vertical mount when turning pages 40.

Figure 5:
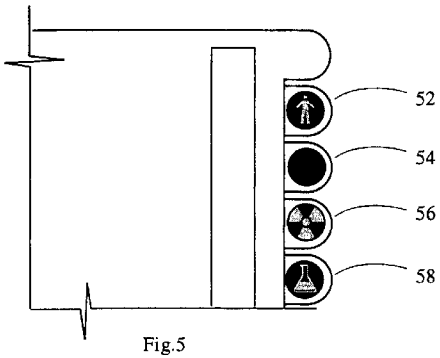
FIG. 5 shows a detail view of the icon-bearing tabs of one embodiment of the present invention.

FIG. 5 shows a detail view of the icon-bearing tabs 50 of one embodiment of the present invention. The icon for the tab 50 corresponding to safety information related to hazardous materials spills on personnel, such as radiological, chemical or biological spills is shown as an outline of a person 52.

The icon for the tab 50 corresponding to safety information related to chemical spills on other surfaces is shown as an outline of an Ehrlenmyer flask 54. The icon for the tab 50 corresponding to safety information related to biological spills on other surfaces is shown as an outline of an international biohazard symbol 56. The icon for the tab 50 corresponding to safety information related to radiation spills on other surfaces is shown as an outline of an international radiation symbol 58. It will be appreciated that many other icons and types of information can be conveyed with the book of the present invention.

The above description of the preferred embodiments is intended to be exemplary of the invention, and not limiting to the appended claims. It is understood that various additional embodiments, modifications, and improvements can be made and are intended to be encompassed within the scope and spirit of the claims.

We claim:

1. A book for vertically displaying information on selected pages thereof, comprising a) front and back covers each having a bound edge and a non-bound edge, and an exterior surface and an interior surface, wherein the exterior surfaces of each cover have permanently attached thereto a releasable mounting means which provides a friction coefficient sufficient to maintain the book mounted in a vertical position on a planar surface unless acted upon by an external force;

b) a plurality of adjacent pages between the front and back covers, each page comprising a bound edge and a non-bound edge, wherein a tab extends from each of the non-bound edges corresponding to the attached page and arranged such that viewing any one tab on a page is not obstructed by the tabs on any of the other pages, and wherein each page is releasably adhered to the adjacent page or adjacent interior surface of a cover such that separation, turning of a page, and re-adhering can be performed in a single-handed operation; and c) a binder for retaining together the front and back covers and the pages, wherein said binder is attached along the bound edge of each of the front and back covers and each of the pages therebetween.

2. The book of claim 1, wherein the releasable mounting means is a hooked surface releasably attached to a reciprocating loop strip backed with an exposable adhesive layer.

3. The book of claim 1, wherein the releasable mounting means is located adjacent the non-bound edges on the exterior surfaces of the covers.

4. The book of claim 1, wherein the pages are releasably adhered by reciprocal hook and loop structures located on adjacent pages.

5. The book of claim 1, wherein the binder is a spiral wire.

6. The book of claim 1, wherein the binder is a ring binder permitting removal and exchange of pages.

7. The book of claim 1, wherein the pages contain laboratory or hospital safety information.

8. The book of claim 1, wherein the pages are laminated with a waterproof material.

* * * * *